US008833895B2

(12) United States Patent
Thayer et al.

(10) Patent No.: US 8,833,895 B2
(45) Date of Patent: Sep. 16, 2014

(54) TRANSFIX ROLLER WITH ADAPTIVE CENTER LOADING FOR USE IN AN INDIRECT PRINTER

(75) Inventors: Bruce E. Thayer, Spencerport, NY (US); Bin Zhang, Penfield, NY (US); Palghat S. Ramesh, Pittsford, NY (US); Rachael L. McGrath, Churchville, NY (US); Christopher A. DiRubio, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 187 days.

(21) Appl. No.: 13/464,346

(22) Filed: May 4, 2012

(65) Prior Publication Data

US 2013/0293616 A1 Nov. 7, 2013

(51) Int. Cl.

| | |
|---|---|
| ***B41J 29/38*** | (2006.01) |
| ***B41J 2/005*** | (2006.01) |
| *B41J 2/01* | (2006.01) |

(52) U.S. Cl.

CPC ..... *B41J 2/0057* (2013.01); *B41J 29/38* (2013.01)

USPC ..... 347/16; 347/103

(58) Field of Classification Search

CPC ..... B41J 2/01; B41J 2/0057; B41J 11/0005; B41J 13/0027; B41J 13/02; B41J 13/036–13/076; B41J 29/38; B41J 29/393

USPC ..... 347/16, 103

See application file for complete search history.

(56) References Cited

U.S. PATENT DOCUMENTS

| | | | | |
|---|---|---|---|---|
| 3,736,869 | A * | 6/1973 | Motter et al. | 101/153 |
| 4,127,066 | A * | 11/1978 | Sharkey | 101/132 |
| 4,253,392 | A * | 3/1981 | Brandon et al. | 100/155 R |
| 4,444,486 | A * | 4/1984 | Monkelbaan | 399/339 |
| 4,827,284 | A * | 5/1989 | Ogiwara | 346/25 |
| 4,827,312 | A * | 5/1989 | Ogiwara et al. | 355/406 |
| 4,905,050 | A * | 2/1990 | Derimiggio et al. | 399/331 |
| 5,057,860 | A * | 10/1991 | Suzuki | 399/279 |
| 5,208,609 | A * | 5/1993 | Chung et al. | 347/232 |
| RE34,503 | E * | 1/1994 | Sakakibara et al. | 355/27 |
| 5,319,430 | A | 6/1994 | DeBolt et al. | |
| 5,777,650 | A | 7/1998 | Blank | |
| 6,375,318 | B1 * | 4/2002 | Johnson | 347/102 |
| 6,527,386 | B1 | 3/2003 | Blank et al. | |
| 6,647,241 | B2 * | 11/2003 | Harashima | 399/389 |
| 7,147,596 | B2 * | 12/2006 | Reynolds | 492/40 |
| 7,931,362 | B2 * | 4/2011 | Burke | 347/103 |
| 8,047,648 | B2 | 11/2011 | Jones et al. | |
| 8,379,232 | B2 * | 2/2013 | Hasegawa et al. | 358/1.1 |
| 2010/0236438 | A1 | 9/2010 | Roof et al. | |
| 2010/0303493 | A1 | 12/2010 | Hamby et al. | |

* cited by examiner

*Primary Examiner* — Laura Martin
*Assistant Examiner* — Jeremy Bishop
(74) *Attorney, Agent, or Firm* — Maginot, Moore & Beck, LLP

(57) ABSTRACT

An image transfer system for use in an indirect printer includes a support roller for a transfix roller. The support roller is configured to apply pressure to a center portion of a nip formed between a transfix roller and an imaging drum while the transfix roller applies pressure to the ends of the nip. This configuration is particularly advantageous for use with imaging drums and transfix rollers having thin walls.

22 Claims, 10 Drawing Sheets

TRANSFIX ROLLER WITH ADAPTIVE CENTER LOADING FOR USE IN AN INDIRECT PRINTER

TECHNICAL FIELD

The system described below relates to printers in which an ink image is transferred from a surface of an image receiving member to a recording medium, and, more particularly, to printers in which the image is transferred to the recording medium as the medium passes through a nip formed between a transfix roller and an image receiving member.

BACKGROUND

The word "printer" as used herein encompasses any apparatus, such as a digital copier, book marking machine, facsimile machine, multi-function machine, etc., that produces an image with a colorant on recording media for any purpose. Printers that form an image on an image receiving member and then transfer the image to recording media are referenced in this document as indirect printers. Indirect printers typically use intermediate transfer, transfix, or transfuse members to facilitate the transfer and fusing of the image from the image receiving member to the recording media. In general, such printing systems typically include a colorant applicator, such as a printhead, that forms an image with colorant on the image receiving member. Recording medium is fed into a nip formed between the surface of the image receiving member and a transfix roller to enable the image to be transferred and fixed to the print medium so the image receiving member can be used for formation of another image.

A schematic diagram for a typical indirect printer that includes a printhead that ejects phase change ink on the image receiving member to form an image on the member is illustrated in FIG. 8. The solid ink imaging device, hereafter simply referred to as a printer 110, has an ink loader 112 that receives and stages solid ink sticks. The ink sticks progress through a feed channel of the loader 112 until they reach an ink melt unit 114. The ink melt unit 114 heats the portion of an ink stick impinging on the ink melt unit 114 to a temperature at which the ink stick melts. The liquefied ink is supplied to one or more printheads 116 by gravity, pump action, or both. Printer controller 122 uses image data to be reproduced on media to control the printheads 116 and eject ink onto a rotating print drum or image receiving member 140 as image pixels to form an ink image. Recording media 120, such as paper or other recording substrates, are fed from a sheet feeder 118 to a position where the ink image on the image receiving member 140 can be transferred to the media. To facilitate the image transfer process, the media 120 are fed into a nip between the transfer, sometimes called transfix roller 150, and the rotating image receiving member 140. In the nip, the transfix roller 150 presses the media 120 against the image receiving member 140. An assembly 124 of lever arms, camshafts, cams, and gears urged into motion by an electrical motor responds to signals from the controller 122 to move the transfix roller into and out of engagement with the image receiving member 140. Indirect or offset printing refers to a process, such as the one just described, of generating an ink or toner image on an intermediate member and then transferring the image onto some recording media or another member.

To optimize image resolution in an indirect printer, the conditions within the nip are carefully controlled. The transferred ink drops should spread out to cover a specific area to preserve image resolution. Too little spreading leaves gaps between the ink drops while too much spreading results in intermingling of the ink drops. Additionally, the nip conditions are controlled to maximize the transfer of ink drops from the image member to the print medium without compromising the spread of the ink drops on the print medium. Moreover, the ink drops should be pressed into the paper with sufficient pressure to prevent their inadvertent removal by abrasion thereby optimizing printed image durability. Thus, the temperature and pressure conditions are important parameters for image quality and need to be carefully controlled throughout the nip.

The image receiving member 140 is a hollow cylinder mounted about a shaft that is supported on its ends by stiff endbells incorporated into the shaft. The shaft of the image receiving member 140 deflects under the pressure of the transfix roller 150 at the nip 144. Some deflection of the image receiving member 140 is inherent. Because the shaft of the image receiving member 140 is supported only at the endbells, it deflects more in the middle than at the ends and, thus, applies more pressure to the nip 144 at the ends than at the middle. However, too much deflection by the image receiving member 140 diminishes the quality of the print because of inconsistencies in the pressure at the nip 144. The thickness of the image receiving member 140 is selected to require as little material as possible to keep manufacturing costs down. However, the thickness of the image receiving member 140 is also selected so that, under pressure from the transfix roller 150 at the nip 144, it does not deflect so much that it diminishes the quality of the print.

The transfix roller 150 includes a cylinder mounted about a shaft and is formed of steel, or another material with similar properties. As described above with reference to the image receiving member 140, the transfix roller 150 deflects more in the middle than at the ends because it is supported only at the ends. The variation in deflection along the length of the transfix roller 150 results in variation of the pressure along the length of the nip 144. The thickness of the transfix roller 150, like that of the image receiving member 140, is selected to balance material costs with the amount of deflection along the transfix roller 150.

When an indirect printer, such as the one shown in FIG. 8, is powered on, the image receiving member needs to be heated to a predetermined temperature that enables the melted phase change ink to remain on the surface of the image receiving member, yet be malleable enough for transfer and fixing to the recording media when the ink image enters the nip. An image receiving member with a larger thermal mass requires more thermal energy and more time to reach the predetermined temperature than an image receiving member that has a smaller thermal mass. One way to reduce the time required for an image receiving member to reach the predetermined temperature is to reduce the thickness of the wall of the image receiving member. While this reduction in wall thickness does decrease the time required for the image receiving member to reach the predetermined temperature, it also affects the pressure conditions in the nip formed with the transfix roller. Without a change in the transfix roller, the pressure in the nip becomes less uniform and weaker in the center of the nip between the ends of the transfix roller and the image receiving member, especially as the walls of the image receiving member are thinned.

As shown in FIG. 9, a nip formed with an image receiving member having a thick wall (for example, 9 mm) has one pressure profile from one end to the other end of the nip across the width of the transfix roller and image receiving member, while a nip formed with an image receiving member having a thin wall (for example, 4.5 mm) has another profile. As used in this document, a "thin wall" refers to a wall of a roller having a thickness that is 7 mm or less, while a "thick wall" refers to a wall of a roller having a thickness that is 8.5 mm or more. The ends of the nip 144 correspond to the ends of the image receiving members 140 and the transfix rollers 150. The pressure profile for the thin wall image receiving member has a pressure at each end of the profile that is greater than the pressure at each end of the profile for the thick wall image receiving member. The pressure is highest at the ends of the nips 144 because the image receiving members 140 and the transfix rollers 150 are supported at the ends and are the most rigid at those areas. Additionally, the pressure in the center of the thin wall image receiving member profile is substantially below the pressure in the center of the thick wall image receiving member profile. The pressure is lowest at the middle of the nips 144 because the image receiving members 140 and the transfix rollers 150 deflect the most at the middle, the area that is the farthest from the supported ends. These pressure differences across the length of the nip may cause wrinkles in the recording media and corresponding print quality defects.

One way to modify the nip conditions to help ensure the print quality is adequate and the media is not distorted with thinner wall image receiving members is to add a crown to the transfix roller. As shown in FIG. 10, a crown 160 is a convex profile formed in the elastomer coat 153 of the transfix roller 150. Accordingly, the diameter 190 of the transfix roller 150 is largest at the middle of the crown 160. The crown 160 provides additional support to the center of the transfix roller 150, increasing pressure at the center of the nip and compensating for the decreased pressure in the center of the nip generated by the thinner wall of the image receiving member. As the wall of the image receiving member is made thinner, the crown of the transfix roller needs to be larger to compensate for the additional image receiving member deflection. The height of a crown, however, is limited by practical constraints in manufacturing and usage.

Additionally, the height of a crown can generate wrinkles and/or image quality defects when print conditions are particularly likely to form either transverse or longitudinal wrinkles. Longitudinal wrinkles are formed in the print media in a direction parallel to the direction that print media is fed through the nip (also known as the process direction). One print condition that is likely to generate longitudinal wrinkles is the center of the print media moving through the nip at a faster rate than the edges of the print media. This condition can result from a crown that is not high enough to compensate for the greater deflection, and resulting lower pressure, in the center of the nip. This condition can also result from high density, process direction images along the edges of the print. Another condition that is likely to generate longitudinal wrinkles is print media being A3 or a similar size. Another condition that is likely to generate longitudinal wrinkles is the orientation of the paper grain in a direction perpendicular to the direction that the print media is fed through the nip (also known as the cross-process direction). Increasing the pressure applied at the center of the nip reduces the occurrence of longitudinal wrinkles.

Transverse wrinkles are formed in the print media in the cross-process direction. One print condition that is likely to generate transverse wrinkles is the edges of the print media moving through the nip at a faster rate than the center of the print media. This condition can result from a crown that is too high and overcompensates for the deflection, resulting in high pressure, in the center of the nip. This condition can also result from high density, process direction images in the center of the print or over the entire print. Another condition that is likely to generate transverse wrinkles is the print media being A3 or a similar size. Another condition that is likely to generate transverse wrinkles is a process direction orientation of the paper grain. Decreasing the pressure applied at the center of the nip reduces the occurrence of transverse wrinkles.

As described above, longitudinal wrinkles and transverse wrinkles can be generated by opposite conditions and, thus be reduced by opposite adjustments. Accordingly, enabling adjustment of the pressure along the nip when print conditions include stresses likely to generate longitudinal or transverse wrinkles is a desirable goal.

SUMMARY

An image transfer system for use in an indirect printer has been developed. The image transfer system includes a first roller, a second roller, and another rotatable roller. The first roller has a cylindrical body with a first length and a first diameter. The second roller has a cylindrical body with a second length and a second diameter. The first length and the second length are substantially equal and the first diameter is greater than the second diameter. The second roller is configured to move into and out of engagement with the first roller to apply pressure to a first end and a second end of the first roller. The other rotatable roller is positioned to interpose at least a portion of the second roller between the first roller and the other rotatable roller. The other rotatable roller has a cylindrical body with a third length, which is substantially less than the first length and the second length. The other roller is configured to apply pressure through the second roller to a location between the first end and the second end of the first roller.

A method of operating a printer to transfer an ink image from an image receiving member to media has been developed. The method includes moving a roller having a thin wall into engagement with the image receiving member to form a nip, applying pressure to a first end and a second end of the roller, and applying pressure to a portion of the roller between the first end and the second end of the roller while media moves through the nip and the pressure is being applied to the first end and the second end of the roller.

A replaceable unit configured for mounting in an image transfer system has been developed. The replaceable unit includes a first roller and another rotatable roller. The first roller has a cylindrical body with a first length and a thin wall. The other rotatable roller has a cylindrical body with a second length, which is substantially less than the first length. The other roller is configured to apply pressure to a first position on the first roller to transfer the pressure to a portion of a nip formed with the first roller and another roller

DETAILED DESCRIPTION

Figure 1:
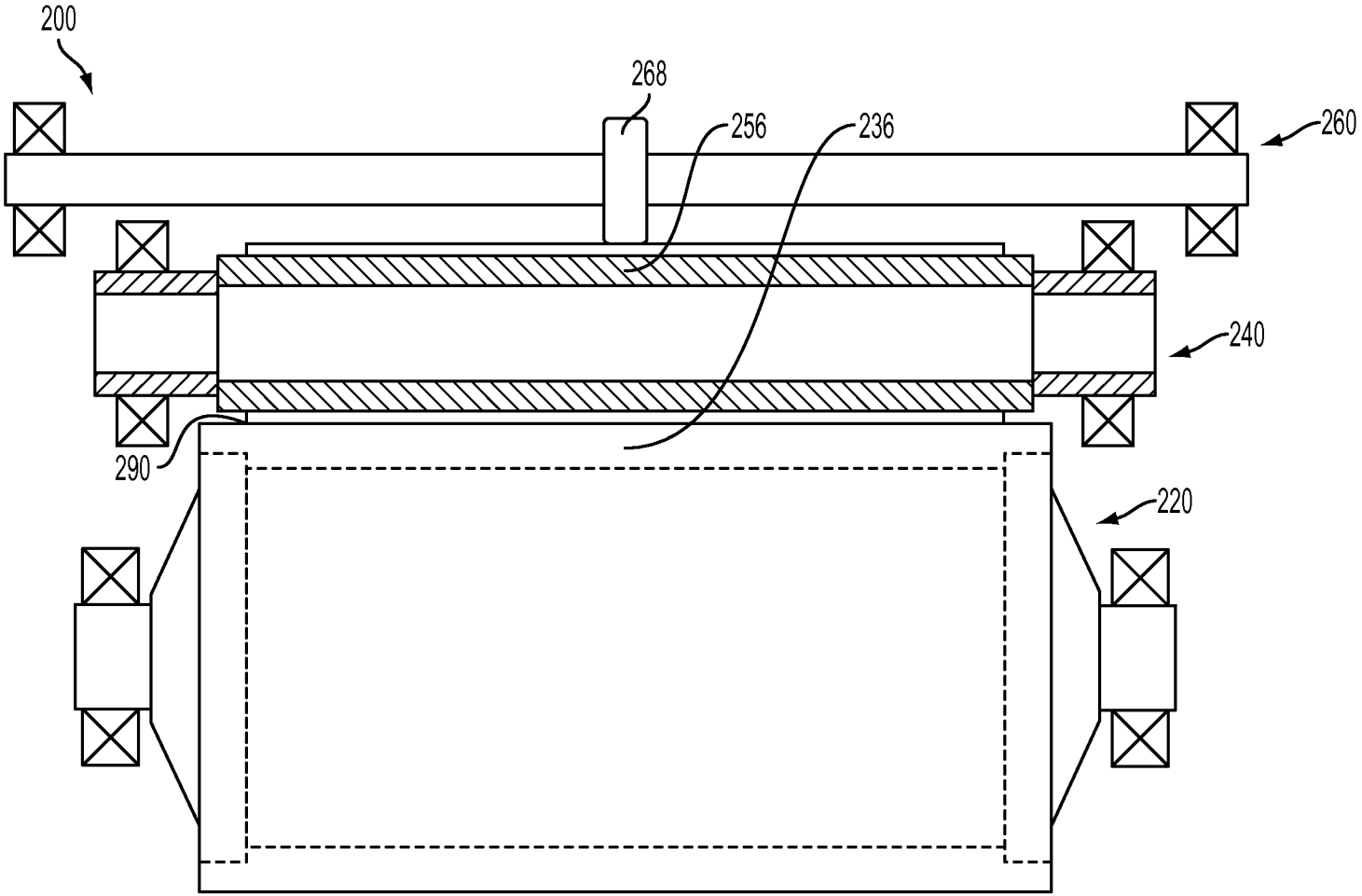
FIG. 1 depicts an image transfer system having an image receiving member, a transfix roller, and a support roller to be used in an indirect printer.

The image transfer system 200 shown in FIG. 1 includes an image receiving member 220, a transfix roller 240 and a support roller 260 that compensates for the deflection at the center of the image receiving member 240 and the pressure variation along the nip 290. The transfix roller 240 is configured in a known manner to be moved into and out of engagement with the image receiving member 220. The transfix roller 240 is configured to apply pressure to the ends of the image receiving member 240 and form the nip 290 for the transfer of the ink images from the image receiving member 220 to media passing through the nip 290. The support roller 260 is configured to be moved into and out of engagement with the transfix roller 240 to apply varying amounts of pressure to the central area of the transfix roller 240. The pressure applied by the support roller 260 is transferred through the transfix roller 240 to the central area of the image receiving member 220 at the nip 290.

Figure 2:
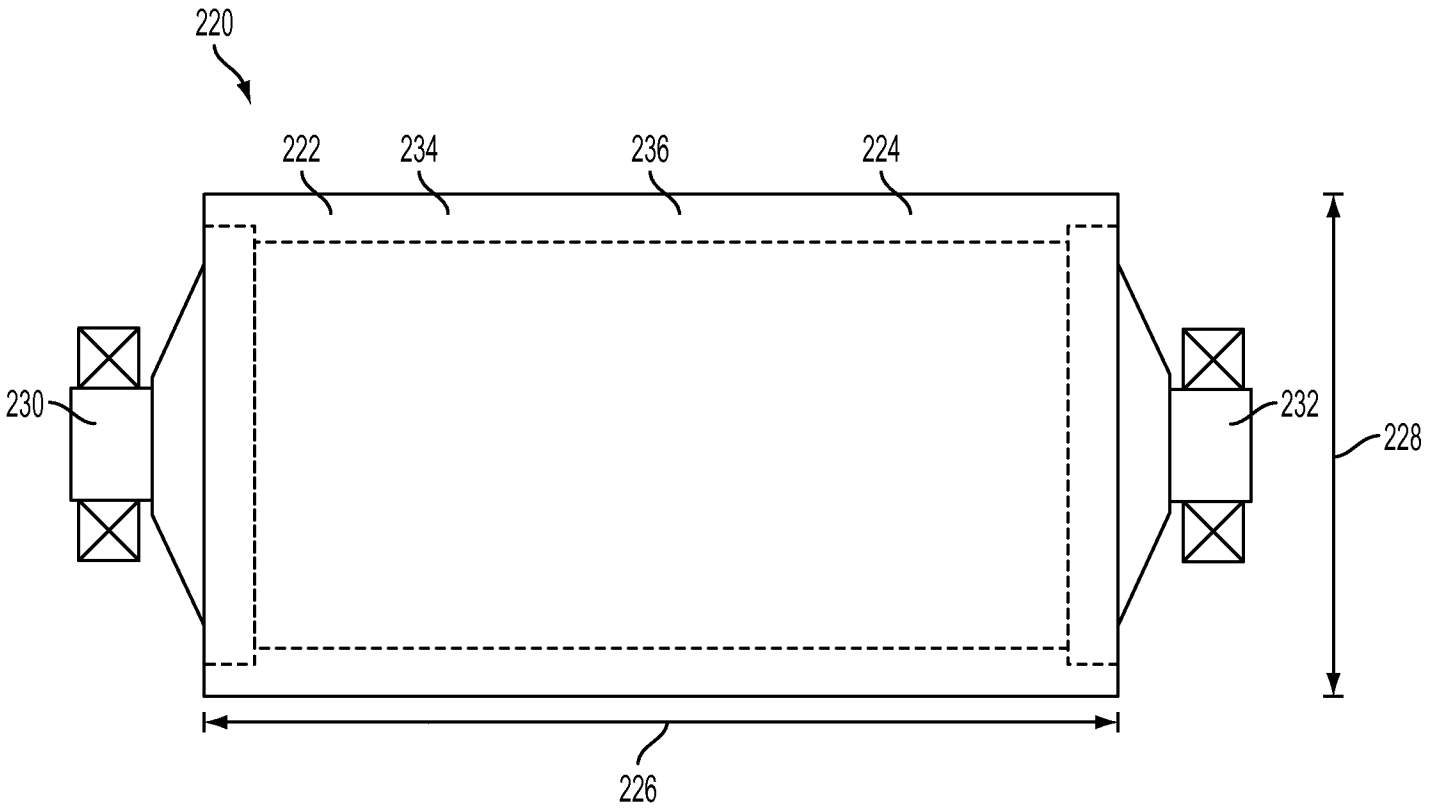
FIG. 2 depicts the image receiving member of FIG. 1.

FIG. 2 depicts detailed features of the image receiving member 220 including an image receiving member wall 222 forming an image receiving member body 224. The image receiving member body 224 is cylindrically shaped and has an image receiving member length 226 and an image receiving member diameter 228. The image receiving member 220 also has a first image receiving member end 230 and an opposite second image receiving member end 232. Between the first image receiving member end 230 and the second image receiving member end 232 is an image receiving member central portion 234 having a middle area 236 that is approximately equidistant between the first image receiving member end 230 and the second image receiving member end 232.

The image receiving member 220 is made of aluminum or of some other material having similar thermal, mechanical and hardness properties. The surface of the image receiving member 220 is one to which ink temporarily adheres upon ejection from a printhead and also one from which ink can be transferred to print media upon application of pressure and heat at the nip 290 (shown in FIG. 1). The image receiving member wall 222 is symmetrical because it rotates to receive ink from the ink applying device, which is configured to form ink images on the image receiving member wall 222, and then deposit the ink on recording media passing through the nip 290 (shown in FIG. 1). The image receiving member length 226 is approximately 13.6 inches to accommodate standard sheets of printing paper as the print media. The image receiving member diameter 228 should be large enough to enable efficient transfer of ink from the image receiving member 220 to the print media as the print media passes through the nip 290 (shown in FIG. 1). For example, if the image receiving member diameter 228 is about 6.33 inches, the image receiving member 220 has a circumference of 19.9 inches and can make one full rotation per printed page for an 11" by 17" sheet of printing paper or two 8.5" by 11" sheets of paper. The image receiving member 220 in FIG. 1 and FIG. 2 has a diameter of about 6.33 inches and has a circumference of 19.9 inches. In other embodiments of the image receiving member described herein, the member has other commonly known diameters and circumferences.

Figure 3:
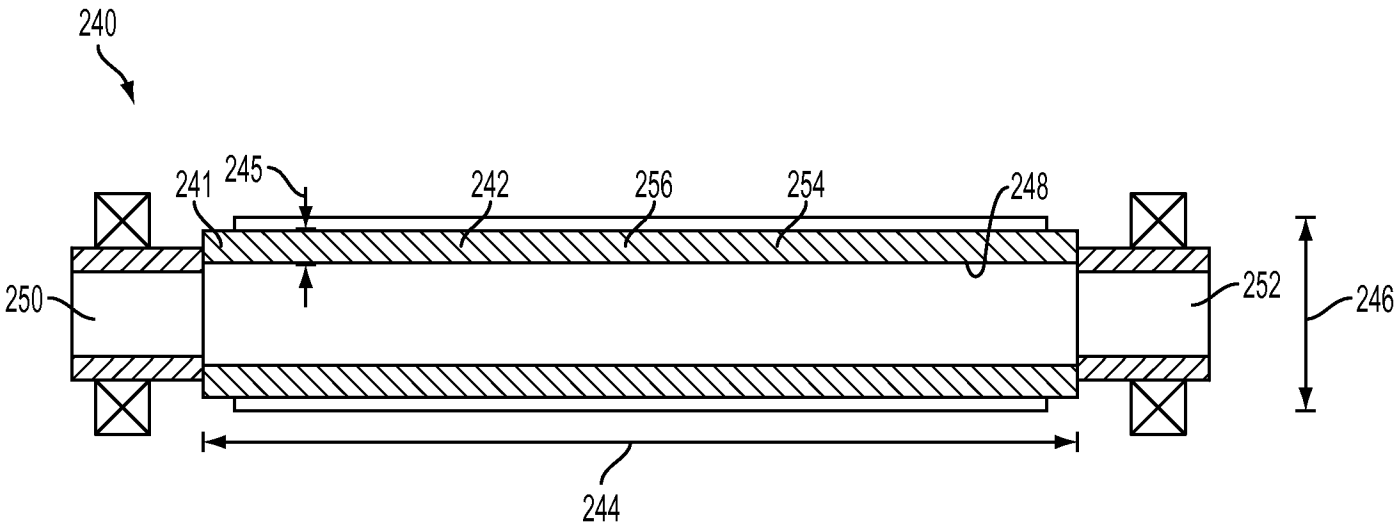
FIG. 3 depicts the transfix roller of FIG. 1.

FIG. 3 depicts detailed features of the transfix roller 240 including a transfix roller wall 241 defining a transfix roller body 242 having a transfix roller length 244 and a transfix roller diameter 246. The transfix roller wall 241 has a thickness 245. The transfix roller body 242 is cylindrically shaped and defines a longitudinal opening 248 therethrough. The transfix roller 240 further includes a first transfix roller end 250 and an opposite second transfix roller end 252. Between the first transfix roller end 250 and the second transfix roller end 252 is a transfix roller central portion 254 including a supported portion 256 which contacts the support roller 260.

The transfix roller length 244 is approximately 13.6 inches long to apply pressure evenly along the width of standard sheets of printing paper as the print media. In other words, the transfix roller length 244 is substantially equal to the image receiving member length 226 (shown in FIG. 2). The transfix roller diameter 246 does not need to be as large as the image receiving member diameter 228 (shown in FIG. 2) because the transfix roller 240 is used to apply pressure to transfer ink from only a portion of the image receiving member 220 to the print media. Thus, the transfix roller 240 can have a circumference of less than 19.9 inches and rotate at a higher frequency than the image receiving member 220.

Figure 8:
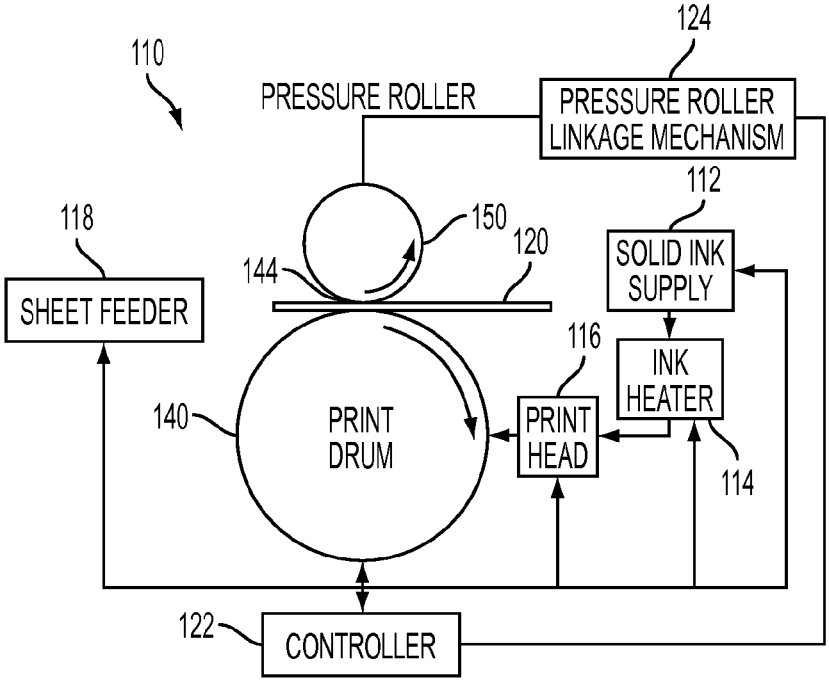
FIG. 8 PRIOR ART
FIG. 8 depicts a typical indirect printer capable of utilizing one of the image transfer systems depicted in FIG. 1, 6 or 7.
Figure 9:
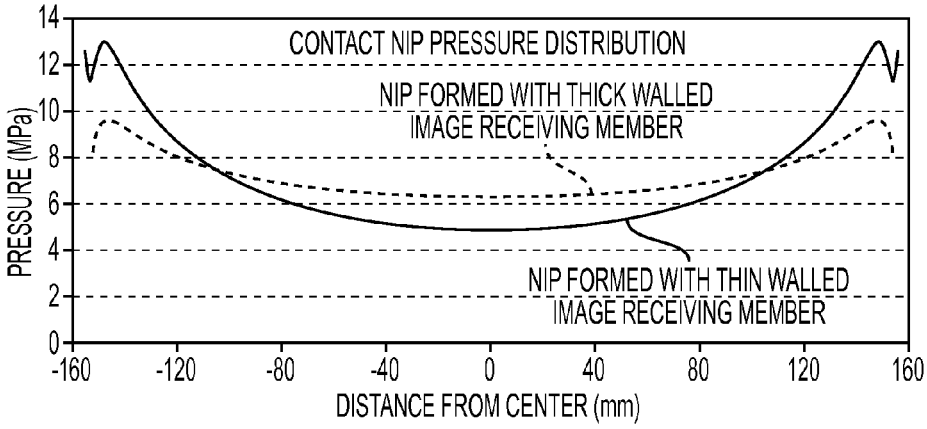
FIG. 9 PRIOR ART
FIG. 9 depicts a graph of a pressure gradient along a nip in a typical indirect printer.
Figure 10:
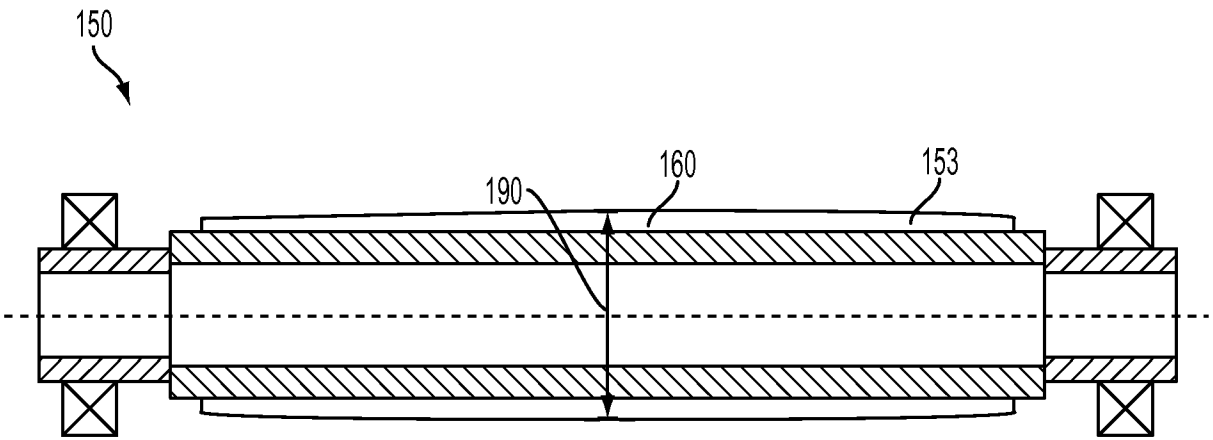
FIG. 10 PRIOR ART
FIG. 10 depicts a transfix roller having a crown.

The transfix roller 240 is slightly more flexible than the transfix roller 150 (shown in FIG. 8). The transfix roller 240 can be made more flexible than the transfix roller 150 by thinning the walls of the roller 150 to the thickness 245 of the walls 241 of the transfix roller body 242. For example, the thickness 245 of the walls 241 can be reduced from approximately 11.6 mm to approximately 2.6 mm. Alternatively, the transfix roller 240 can be made more flexible than the transfix roller 150 by making the transfix roller body 242 out of a material having a lower elastic modulus than steel. Alternatively, the transfix roller 240 can be made more flexible than the transfix roller 150 by thinning the walls 241 and making the transfix roller body 242 out of a material having a lower elastic modulus than steel. The flexibility of the transfix roller 240 enables it to receive and distribute loads applied at various points along the transfix roller length 244 to generate a more uniform pressure at the nip 290 (shown in FIG. 1).

Figure 4:
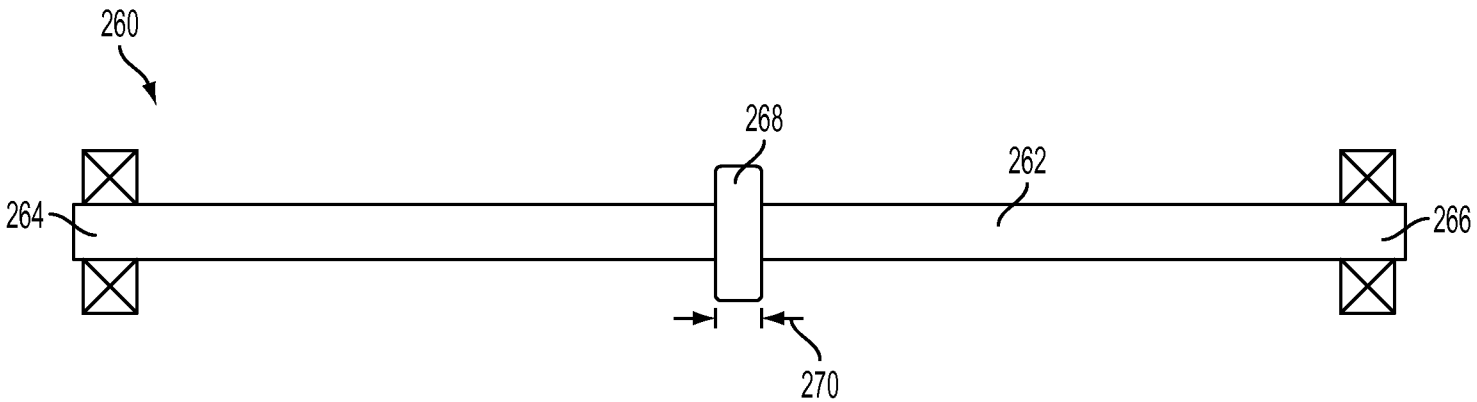
FIG. 4 depicts the support roller of FIG. 1.

FIG. 4 depicts detailed features of the support roller 260 including a support roller shaft 262 and a support roller body 268. The support roller shaft 262 has a first support roller shaft end 264 and an opposite second support roller shaft end 266. The support roller body 268 has a support roller length 270. The support roller body 268 is cylindrically shaped and is positioned on the support roller shaft 262 to contact the supported portion 256 of the transfix roller 240 (shown in FIG. 3). In other words, the support roller body 268 is positioned at a location approximately equidistant between the first image receiving member end 230 and the second image receiving member end 232 (shown in FIG. 2) when the support roller 260 is arranged in the image transfer system shown in FIG. 1. The support roller length 270 is substantially less than the transfix roller length 244 (shown in FIG. 3) and the image receiving member length 226 (shown in FIG. 2) because the support roller 260 applies pressure to only a small area in the central portion 254 of the transfix roller 240 (shown in FIG. 3).

Returning to FIG. 1, the image transfer system 200 is arranged such that the transfix roller 240 is positioned between the support roller 260 and the image receiving member 220. This arrangement enables the support roller 260 to apply pressure through the transfix roller 240 to the image receiving member 220. The location of the support roller body 268 at the supported portion 256 of the transfix roller 240 enables the support roller 260 to apply pressure to the middle area 236 of the image receiving member 220.

Figure 5:
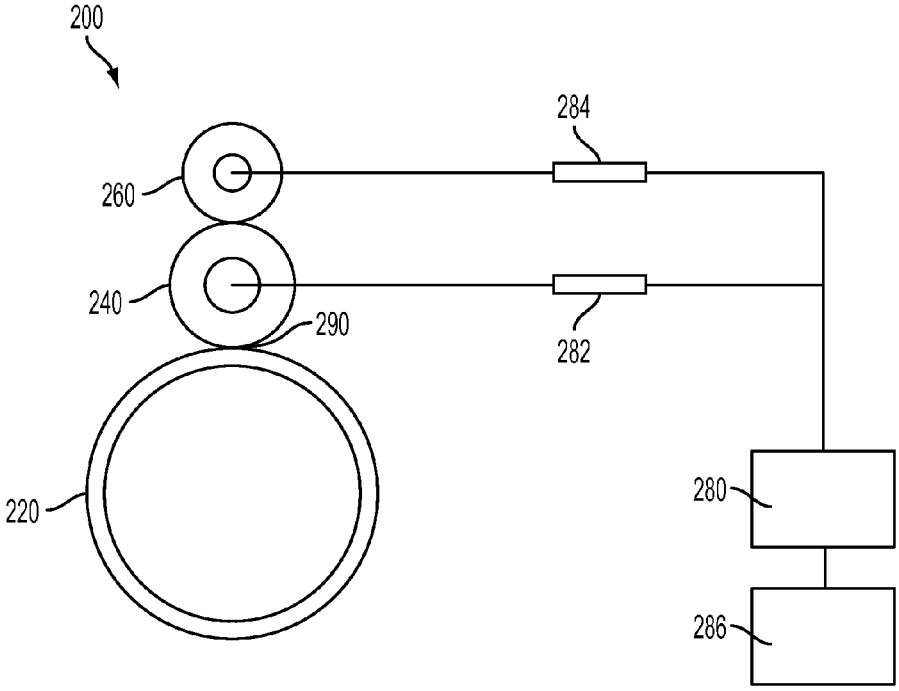
FIG. 5 depicts a side view of the image transfer system of FIG. 1 also including a controller and actuators.

FIG. 5 is a schematic diagram depicting an end view of the image transfer system 200. As is illustrated more clearly from an end view, the image transfer system 200 includes a system of rotatable cylindrical rollers. In particular, the image receiving member 220 acts as a first roller, the transfix roller 240 acts as a second roller, cooperating with the first roller to form the nip 290, and the support roller 260 acts as a third roller (also referred to as another rotatable roller or a single rotatable roller or a rotatable roller), interposing at least a portion of the second roller between the first roller and the third roller. Thus, the third roller (or the support roller 260) is configured to influence the nip 290 formed between the first roller (the image receiving member 220) and the second roller (the transfix roller 240) by acting on the second roller (the transfix roller 240).

As shown in FIG. 5, the image transfer system 200 further includes a controller 280, a transfix roller actuator 282, and a support roller actuator 284. The transfix roller actuator 282 is operatively connected to the transfix roller 240 and to the controller 280. The support roller actuator 284 is operatively connected to the support roller 260 and to the controller 280. The controller 280 is configured to operate the transfix roller actuator 282 to move the first transfix roller end 250 and the second transfix roller end 252 (shown in FIG. 3) toward the first image receiving member end 230 and the second image receiving member end 232 (shown in FIG. 2), respectively. The controller 280 is also configured to operate the support roller actuator 284 to move the first support roller shaft end 264 and the second support roller shaft end 266 (shown in FIG. 4) toward the first transfix roller end 250 and the second transfix roller end 252 (shown in FIG. 3), respectively. Thus, the controller 280 is configured to move the transfix roller 240 toward the image receiving member 220 to generate pressure at the ends of the nip 290 and to move the support roller 260 toward the transfix roller 240 to generate pressure at the center of the nip 290.

The controller 280 is further configured to receive data pertaining to print conditions that are likely to generate longitudinal wrinkles or are likely to generate transverse wrinkles. The data can include a longitudinal stress parameter or a transverse stress parameter such as, for example, a paper type or an amount and distribution of ink to be used to print an image. In particular, data pertaining to the paper type can include paper size, stiffness, and grain direction. Data pertaining to the amount and distribution of ink to be used can include the location of ink on the page, ink density at the center of the page, ink density at the edges of the page, and ink density across the whole page. The controller 280 is configured to use these data to identify a wrinkle parameter for an ink image to be printed.

The controller 280 is configured to operate the transfix roller actuator 282 and the support roller actuator 284 with reference to the identified wrinkle parameter for an ink image. In particular, the controller 280 is configured to adjust the pressure applied to the image receiving member 220 at the ends of the nip 290 by the transfix roller 240 and at the center of the nip 290 by the support roller 260. These adjustments can regulate the pressure applied along the length of the nip 290 to avoid generating wrinkles during printing. Additionally, these adjustments can be made while the printer is in operation, avoiding time-consuming reprinting or manual adjustment of the image transfer system 200.

The controller 280 can be configured with electronic components and programmed instructions stored in a memory operatively connected to or made part of the controller. In response to the controller 280 executing the programmed instructions and operating the electronic components, the controller receives data, such as the data described above, and identifies a wrinkle parameter for an image to be printed. In one embodiment, the controller 280 can be configured to receive data from a user interface 286 operatively connected to the controller 280 and operated by a user. The user identifies printed pages that are wrinkled and then enters information about each wrinkled page into the user interface 286. The user can enter information about, for example, the paper type, the amount and distribution of the ink, the presence of longitudinal wrinkles, and the presence of transverse wrinkles. The controller 280 adjusts the pressure along the nip 290 with respect to the information entered into the user interface 286 and reprints the pages. Alternatively, the printer can scan printed pages for wrinkles and the controller 280 can receive the above information via a feedback loop rather than from the user interface 286.

In another embodiment, the controller 280 can be configured to receive data pertaining to images to be printed prior to printing. The controller 280 can then adjust the pressure at the nip 290 with respect to the data to avoid printing wrinkled pages. Before commencing printing, the paper size, stiffness, and grain direction for the pages to be printed can each be entered manually or the information can be stored within the controller 280 and identified according to the paper type entered by the user. Additionally, the printer can generate electronic image information for images to be printed, including, for example, the location of ink on the page or the ink density at the center and the edges of the page and over the whole page. The controller 280 can use the data pertaining to the paper type and to the amount and distribution of the ink to identify wrinkle parameters for the images to be printed and adjust the pressure applied along the nip 290 to compensate for the wrinkle parameters and prevent wrinkled prints.

In another embodiment, the controller 280 can be configured to store data received from the user interface or from within the printer in a memory. The controller 280 can thus generate a catalog of data and wrinkle parameters and use the catalog to identify conditions of new print jobs that are likely to generate wrinkled prints and adjust the pressure along the nip 290 accordingly. The controller 280 can, thus, gradually eliminate the need to receive data pertaining to wrinkle parameters from a user. Additionally, the controller 280 can be configured to receive the data from a network connected to other printers. The catalogs of the printers in the network can be combined to identify a greater number of conditions likely to generate wrinkled prints and the controller 280 can receive data from the combined catalog.

Referring now to FIGS. 1-5, in operation, the image transfer system 200 applies pressure to both the edges and the center of the nip 290 and varies the amount of pressure applied to the center of the nip 290 to prevent the formation of longitudinal and transverse wrinkles. The controller 280 operates the transfix member actuator 282 to move the first and second transfix roller ends 250, 252 toward the first and second image receiving member ends 230, 232. The controller 280 thereby moves the transfix roller 240 into engagement with the image receiving member 220 to form the nip 290. The controller 280 regulates the amount of pressure applied to the image receiving member 220 at the ends of the nip 290 by controlling the force generated by the transfix member actuator 282 upon the first and second transfix roller ends 250, 252.

The controller 280 also operates the support roller actuator 284 to move the first and second support roller shaft ends 264, 266 toward the first and second transfix roller ends 250, 252. The controller 280 thereby moves the support roller body 268 into engagement with the transfix roller 240. The pressure applied to the support roller 260 is transferred through the support roller body 268, through the supported portion 256 of the transfix roller 240, and to the image receiving member 220 at the center of the nip 290. The pressure applied to the transfix roller 240 by the support roller 260 increases the amount of pressure applied to the nip 290 by moving the transfix roller 240 into engagement with the image receiving member 220. Accordingly, a transfix roller 240 with thinner walls can be used with fewer concerns about the transfix roller 240 being too flexible and being unable to apply enough pressure to the image receiving member 220. As mentioned above, the walls 241 can have a thickness of, for example, 2.6 mm.

The pressure applied by the support roller 260 is applied to a location on the image receiving member 220 that is approximately equidistant between the first and second image receiving member ends 230, 232. The controller 280 regulates the amount of pressure applied to the image receiving member 220 at the center of the nip 290 by controlling the force exerted by the support roller actuator 284 upon the first and second support roller shaft ends 264, 266.

Thus, the controller 280 simultaneously controls the amount of pressure applied to the image receiving member 220 at both the ends and the center of the nip 290 while media moves through the nip 290. The amount of pressure applied by the transfix roller 240 to the ends of the nip 290 can be different than the amount of pressure applied by the support roller 260 to the center of the nip 290. Additionally, the controller 280 can vary the amounts of pressure applied to the ends and/or to the center of the nip 290 as necessary during operation of the printer to achieve and maintain the desired load along the length of the nip 290.

The controller 280 receives data to identify the wrinkle parameter for an image to be printed. The controller 280 then operates the transfix roller actuator 282 and the support roller actuator 284 with reference to the identified wrinkle parameter. When the identified wrinkle parameter indicates that the image to be printed includes stresses likely to generate longitudinal wrinkles, the controller 280 operates the transfix roller actuator 282 and the support roller actuator 284 such that the amount of pressure applied to the image receiving member 220 at the center of the nip 290 by the support roller 260 is increased relative to the amount of pressure applied to the image receiving member 220 at the ends of the nip 290 by the transfix roller 240. Conversely, when the identified wrinkle parameter indicates that the image to be printed includes stresses likely to generate transverse wrinkles, the controller 280 operates the transfix roller actuator 282 and the support roller actuator 284 such that the amount of pressure applied to the image receiving member 220 at the center of the nip 290 by the support roller 260 is decreased relative to the amount of pressure applied to the image receiving member 220 at the ends of the nip 290 by the transfix roller 240.

Figure 6:
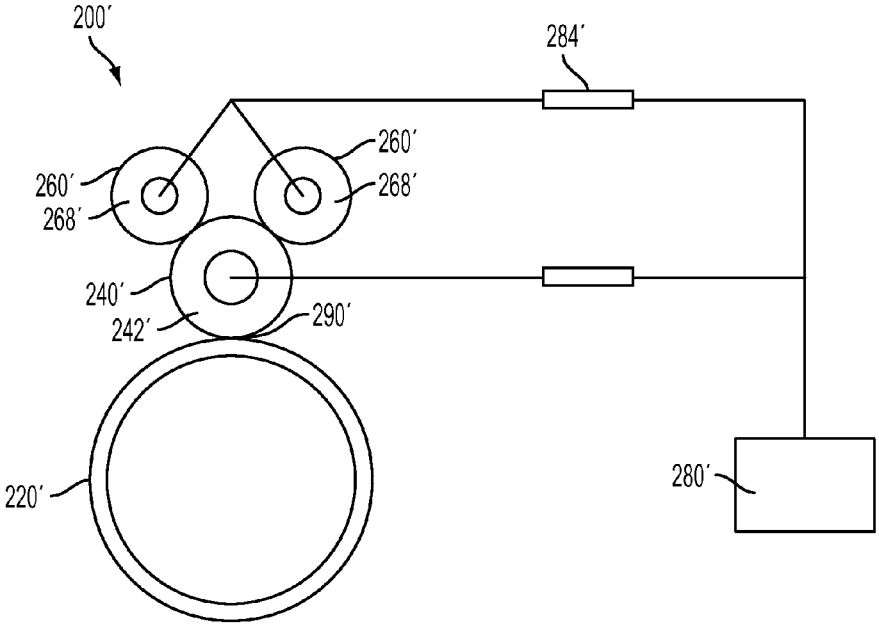
FIG. 6 depicts another image transfer system having an image receiving member, a transfix roller, two support roller, a controller, and actuators to be used in an indirect printer.

In an alternative embodiment, the image transfer system 200 can include more than one support roller 260. For example, as illustrated in FIG. 6, the image transfer system 200' includes two support rollers 260'. The image transfer system 200' is configured and operates in substantially the same manner as image transfer system 200 described above, except that the controller 280' operates the support roller actuator 284' to move two support roller bodies 268' into contact with the transfix roller 240' to apply pressure to the image receiving member 220' at the center of the nip 290'. As shown in FIG. 6, the two support rollers 260' are positioned at a different location on the circumference of the transfix roller body 242'. A front view of the image transfer system 200' is substantially identical to the front view of the image transfer system 200 shown in FIG. 1 because both support roller bodies 268' are aligned along the length of the image receiving member 220' and are positioned approximately equidistantly between the first and second image receiving member ends.

Figure 7:
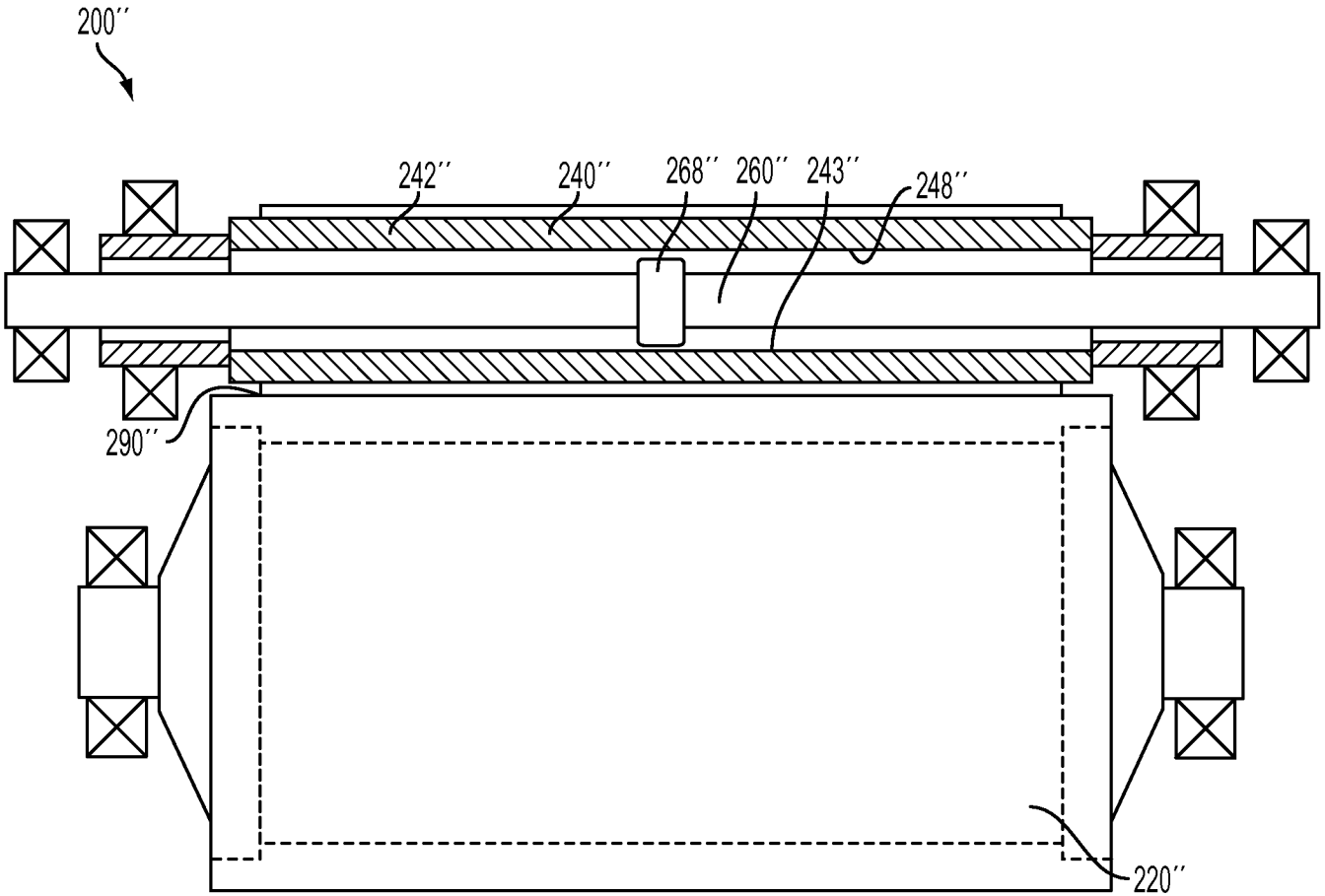
FIG. 7 depicts another image transfer system having an image receiving member, a transfix roller, and a support roller located within the transfix roller to be used in an indirect printer.

In another alternative embodiment, shown in FIG. 7, the image transfer system 200" includes a support roller 260" positioned within the longitudinal opening 248" of the transfix roller body 242". The image transfer system 200" is configured and operates in substantially the same manner as image transfer system 200 described above, except that only a portion of the transfix roller 240", rather than the entire transfix roller 240, is interposed between the support roller 260" and the image receiving member 220". The support roller body 268" moves into contact with an inside surface 243" of the transfix roller body 242" and the pressure applied to the support roller 260" is transferred through the transfix roller body 242" to the image receiving member 220" at the center of the nip 290".

The image transfer system 200" having a support roller 260" internally located within the transfix roller 240" is preferred because it avoids adding wear to the outer surface of the transfix roller 240". Use of an internally located support roller 260" is only possible in a printer that has a transfix roller large enough to contain the support roller 260" and operate properly. In a printer that has a smaller transfix roller, an externally located support roller 260 or 260' is required due to practical size limitations.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An image transfer system for use in an indirect printer comprising:

a first roller having a cylindrical body with a first length and a first diameter;

a second roller having a cylindrical body with a second length and a second diameter, the first length and the second length being substantially equal and the first diameter being greater than the second diameter, the second roller being configured to move into and out of engagement with the first roller to apply pressure to a first end and a second end of the first roller;

at least one other rotatable roller positioned to interpose at least a portion of the second roller between the first roller and the at least one other rotatable roller, the at least one other rotatable roller having a cylindrical body having a third length, which is substantially less than the first length and the second length, and the at least one other roller being configured to apply pressure through the second roller to at least one location between the first end and the second end of the first roller;

at least one actuator operatively connected to the second roller;

at least one other actuator operatively connected to the at least one other rotatable roller; and a controller operatively connected to the at least one actuator and to the at least one other actuator, the controller being configured to operate with reference to a wrinkle parameter the at least one actuator to apply a first pressure to the first end and the second end of the second roller and to operate the at least one other actuator to apply a second pressure to the at least one other rotatable roller, the second pressure being greater than the first pressure in response to the wrinkle parameter indicating a longitudinal wrinkle and the second pressure being less than the first pressure in response to the wrinkle parameter indicating a transverse wrinkle.

2. The image transfer system of claim 1 wherein the at least one other rotatable roller is a single rotatable roller positioned to interpose the at least a portion of the second roller between the first roller and the single rotatable roller, and the single rotatable roller is positioned at a location that is approximately equidistant between the first end and the second end of the first roller.

3. The image transfer system of claim 1 wherein the at least one other rotatable roller is at least two rotatable rollers positioned to interpose at least the portion of the second roller between the first roller and the at least two other rotatable rollers, and each of the at least two rotatable rollers is positioned at different locations on a circumference of the cylindrical body of the second roller.

4. The image transfer system of claim 1 wherein the at least one rotatable roller is positioned within the cylindrical body of the second roller and is configured to apply pressure to the cylindrical body between the at least one rotatable roller and the first roller.

5. The image transfer system of claim 1, the controller being further configured to identify the wrinkle parameter with reference to an image to be printed.

6. The image transfer system of claim 5, the controller being further configured to identify the wrinkle parameter with reference to an amount and distribution of ink to be used to print the image to be printed.

7. The image transfer system of claim 5, the controller being further configured to identify the wrinkle parameter for an image to be printed with reference to a location of ink in the image to be printed.

8. The image transfer system of claim 5 further comprising:

a user interface operatively connected to the controller and the controller being further configured to receive data from the user interface to identify the wrinkle parameter.

9. The image transfer system of claim 1 wherein at least one of the cylindrical body of the first roller and the cylindrical body of the second roller has a thin wall.

10. A method of operating a printer to transfer an ink image from an image receiving member to media comprising:

moving a first roller having a thin wall into engagement with the image receiving member to form a nip;

operating with a controller at least one actuator to apply a first pressure to the first end and the second end of the first roller;

operating with the controller at least one other actuator to apply a second pressure to at least one other roller that contacts the first roller between a first end and a second end of the first roller, the controller operating the at least one actuator and the at least one other actuator with reference to a wrinkle parameter to make the second pressure greater than the first pressure in response to the wrinkle parameter indicating a longitudinal wrinkle and to make the second pressure less than the first pressure in response to the wrinkle parameter indicating a transverse wrinkle.

11. The method of claim 10 wherein the at least one other roller is a single rotatable roller.

12. The method of claim 11 wherein the single rotatable roller is positioned at a location that is approximately equidistant between the first end and the second end of the first roller.

13. The method of claim 10 wherein the at least one other roller is at least two rotatable rollers, each of the at least two rotatable rollers being positioned at different locations on a circumference of a cylindrical body of the first roller.

14. The method of claim 11 wherein the single rotatable roller is positioned within a cylindrical body of the first roller.

15. The method of claim 10 further comprising:

identifying the wrinkle parameter with reference to an image to be printed.

16. The method of claim 15 further comprising:

identifying the wrinkle parameter with reference to an amount and distribution of ink to be used to print the image to be printed.

17. The method of claim 15 further comprising:

identifying the wrinkle parameter with reference to a location of ink on the image to be printed.

18. The method of claim 15 further comprising:

receiving data from a user interface to identify the wrinkle parameter.

19. A replaceable unit configured for mounting in an image transfer system, the replaceable unit comprising:

a first roller having a cylindrical body with a first length and a thin wall;

at least one other rotatable roller having a cylindrical body having a second length, which is substantially less than the first length, the at least one other rotatable roller being configured to apply pressure to a first position on the first roller to transfer the pressure to a portion of a nip formed with the first roller and another roller;

at least one actuator operatively connected to the first roller;

at least one other actuator operatively connected to the at least one other roller; and a controller operatively connected to the at least one actuator and to the at least one other actuator, the controller being configured to operate with reference to a wrinkle parameter the at least one actuator to apply a first pressure to a first end and a second end of the first roller and to operate the at least one other actuator to apply a second pressure to the at least one other rotatable roller, the second pressure being greater than the first pressure in response to the wrinkle parameter indicating a longitudinal wrinkle and the second pressure being less than the first pressure in response to the wrinkle parameter indicating a transverse wrinkle.

20. The replaceable unit of claim 19 wherein the at least one other rotatable roller is positioned at a location that is approximately equidistant between the first end and the second end of the first roller.

21. The replaceable unit of claim 19 wherein the at least one other rotatable roller is at least two other rotatable rollers positioned to apply pressure to the first roller, and each of the at least two other rotatable rollers is positioned at different locations on a circumference of the cylindrical body of the first roller.

22. The replaceable unit of claim 19 wherein the at least one rotatable roller is positioned within the cylindrical body of the first roller and is configured to apply pressure to an inside surface of the cylindrical body of the first roller.

* * * * *